US005253861A

United States Patent [19]

Schmaling

[11] Patent Number: 5,253,861

[45] Date of Patent: Oct. 19, 1993

[54] DOCUMENT REGISTRATION APPARATUS WITH IMPROVEMENT TO PREVENT SHINGLING DURING REMOVAL OF DOCUMENTS

[75] Inventor: Roderick N. Schmaling, Brookfield Center, Conn.

[73] Assignee: Pitney Bowes Inc., Stamford, Conn.

[21] Appl. No.: 937,623

[22] Filed: Aug. 28, 1992

[51] Int. Cl.[5] ..... B65H 31/04

[52] U.S. Cl. ..... 271/213; 271/209; 271/220; 271/273; 271/245

[58] Field of Search ..... 271/245, 273, 274, 209, 271/213, 220

[56] References Cited

U.S. PATENT DOCUMENTS

| | | | |
|---|---|---|---|
| 824,755 | 7/1906 | Sturtevant . | |
| 3,637,203 | 1/1972 | French | 271/53 |
| 3,661,383 | 5/1972 | Morrison | 271/51 |
| 3,688,890 | 9/1972 | Brockmuller | 271/213 |
| 3,944,211 | 3/1976 | Rasmussen et al. | 271/245 X |
| 4,006,831 | 2/1977 | Jimenez | 271/213 X |
| 4,078,790 | 3/1978 | Stocker | 271/213 |
| 4,533,135 | 8/1985 | Barker | 271/275 |
| 4,570,923 | 2/1986 | Hooper et al. | 271/275 |
| 4,606,536 | 8/1986 | Ohara | 271/118 |
| 4,630,815 | 12/1986 | Petersen et al. | 271/273 |
| 4,750,853 | 6/1988 | Van Soest et al. | 414/43 |
| 4,815,726 | 3/1989 | Pagowski et al. | 271/274 |
| 5,094,443 | 3/1992 | Young, Jr. | 271/245 |

FOREIGN PATENT DOCUMENTS

| | | | |
|---|---|---|---|
| 244834 | 10/1987 | Japan | 271/273 |
| 265838 | 10/1990 | Japan | 271/273 |
| 310228 | 12/1990 | Japan | 271/273 |

*Primary Examiner*—Robert P. Olszewski
*Assistant Examiner*—Boris Milef
*Attorney, Agent, or Firm*—Charles R. Malandra, Jr.; Melvin J. Scolnick

[57] ABSTRACT

An improvement is provided to a document registration apparatus that includes a plurality of laterally-spaced registration stops which pivot about a horizontal axis for stopping motion of documents and registering the leading edge of the documents to a particular direction in the apparatus, and also includes at least one pinch roller cooperatively operating with conveying structure for moving the registered documents away from the apparatus for further processing. The improvement includes structure for supporting the documents above the conveying structure when the documents are against the registration stops.

8 Claims, 4 Drawing Sheets

DOCUMENT REGISTRATION APPARATUS WITH IMPROVEMENT TO PREVENT SHINGLING DURING REMOVAL OF DOCUMENTS

RELATED APPLICATIONS

The present application is related to U.S. application Ser. No. 808,863, filed Dec. 17, 1991; U.S. application Ser. No. 906,200, filed Jun. 29, 1992; and U.S. application Ser. No. 906,170, filed Jun. 29, 1992, each of which co-pending applications is assigned to the assignee of the present invention. The specific and entire disclosure each of the aforementioned applications is specifically incorporated herein by reference for the purpose of further explaining the nature of the present invention.

FIELD OF THE INVENTION

The present invention relates to a document registration apparatus for use in a document processing system, and more particularly, for use in a document queuing station.

BACKGROUND OF THE INVENTION

Various document processing systems, such as in an inserting machine, require that a document is aligned relative to a particular station in the system prior to being processed at the station. Typically, this is accomplished by registering a particular edge of the document in a particular direction in the system. For example, documents must be aligned before being conveyed to a folding apparatus to achieve a proper fold. Also, enclosures which are to be inserted into an envelope should be aligned relative to the envelope prior to insertion in order to avoid processing difficulties. Furthermore, some documents which are to be transported away from a particular queuing station, to another adjacent document raceway, should be aligned at the queuing station relative to the raceway, in order to facilitate the processing of the documents.

Devices which register a particular edge of a document to a particular direction are known. See, for example, U.S. Pat. Nos. 3,637,203, 4,078,790 and 4,925,180, which utilize stops that pivot into position to stop the advancement of documents being conveyed in a particular direction. Some registration devices, such as stationary side guides, perform the task of aligning the document while the document is being conveyed. Other devices, such as a "queuing" station, perform the dual task of aligning the document and stopping the document until the next successive station is ready to receive the document for further processing. Typically, queuing stations comprise mechanisms which register the document by stopping, i.e., queuing, the document. Queuing stations are typically configured to handle documents of a particular length and are not easily reconfigured to handle sheets of a different length. Queuing stations are generally comprised of a complex mechanical design that is subject to frequent mechanical failure. For this reason, a reconfiguration of a queuing station normally requires a service call by a skilled technician.

In U.S. patent application Ser. No. 808,863, noted previously herein, a document registration apparatus in the form of a queuing station is disclosed. The apparatus has a plurality of registration stops for stopping the conveyance of a document and registering a particular edge of a document to a particular direction in the apparatus. The registration apparatus also includes at least one pinch roller for moving the registered document away from the apparatus for further processing. The document registration apparatus also includes a jam access hinge for providing access to a jammed document. In U.S. patent application Ser. No. 906,200, noted previously herein, a similar document registration apparatus is disclosed with additional structure for performing skew adjustment. In U.S. patent application Ser. No. 906,170, noted previously herein, a further document registration apparatus is disclosed with additional structure for handling various sized documents.

Generally, during the stacking and registration of documents there is always the potential for the documents to become shingled, i.e., the top document in the stack is not directly above the lower documents but slightly shifted forward or backward, as they are conveyed from a stacking and registration area. Thus, the design and operation of a queuing station may result in undesirable shingling of documents.

The aforementioned document registration apparatus of U.S. applications Ser. Nos. 808,863, 906,200, and 906,170 include pinch rollers cooperatively operating with transport belts to remove the documents from the queuing station. The pinch rollers pivot into engagement with the stack as the registration stops pivot out of the way. Although this arrangement has been found to reduce the shingling of the stack of documents, it has not eliminated such shingling.

SUMMARY OF THE INVENTION

In light of the above, it has been found that a document registration apparatus can include structure which eliminates documents from becoming shingled as they are removed from the station where they are stacked and registered. It has further been found that such structure is suitable for use in a queuing station having a plurality of stops that can be adjustably positioned along a paper path for handling various sized documents and that can be adjusted for skew.

In accordance with the present invention, an improvement is provided to a document registration apparatus that includes a plurality of laterally-spaced registration stops which pivot about a horizontal axis for stopping motion of documents and registering the leading edge of the documents to a particular direction in the apparatus, and also includes at least one pinch roller cooperatively operating with conveying structure for moving the registered documents away from the apparatus for further processing. The improvement includes structure for supporting the documents above the conveying structure when the documents are against the registration stops.

The conveying structure includes a pair of transport belts and the supporting structure includes a least a pair of deck rails laterally positioned between the transport belts. A pair of pinch rollers urge the document against the transport belts when the registration stops move away from the document path.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figure 1:
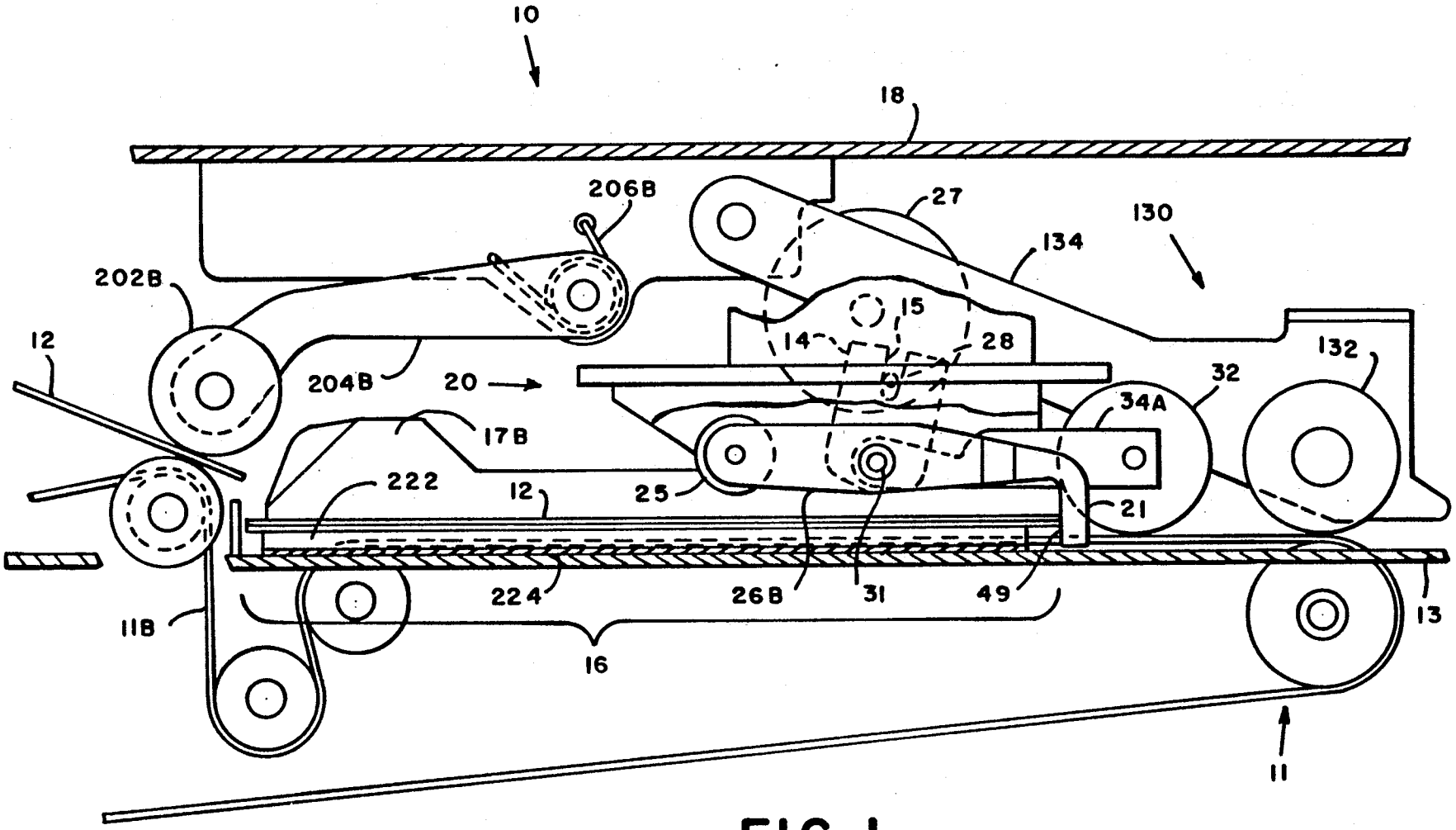
FIG. 1 is a side elevational view of a document registration apparatus in accordance with the present invention, with stops lowered to stack and register documents.

The present invention is part of a document processing system, such as an inserting machine, comprising a plurality of stations situated successively along a paper path for processing documents conveyed along the path. The present invention is an improvement to the document registration apparatus disclosed in the aforementioned U.S. patent applications Ser. Nos. 808,863, 906,200 and 906,170 which have been incorporated herein by reference.

With reference to FIGS. 1-5, a document registration apparatus, generally shown as 10, is used in conjunction with a document transport system, generally designated 11. Registration apparatus 10 cooperates with transport system 11 in transporting a document 12' along a path 13 in an upstream to downstream direction, shown left to right in FIGS. 1 and 3. There is a document registration position 16 where each document 12' is stopped in its path by registration unit 10 and is held or "queued" until the next successive station in the processing system is ready to process a stack of documents 12. Document registration apparatus 10 simultaneously stops and aligns each document 12' relative to path 13.

Each document 12' is separately transported, for example from a sheet feeder (not shown), by transport system 11. In the preferred embodiment of the present invention, transport system 11 includes two transport belts 11A and 11B which move in synchronization. Apparatus 10 includes a top plate 18 and a pair of pinch rollers 202A and 202B that are respectively mounted to one end of arms 204A and 204B. (Roller 202A and arm 204A are not shown but are designated to show cooperative relationship to belt 11B.) Arms 204A and 204B are mounted at their other ends to top plate 18 of apparatus 10 and are biased toward belts 11A and 11B respectively by springs 206A (not shown) and 206B. Thus, pinch rollers 202A and 202B apply a normal force to document 12' as it is transported by belts 11A and 11B to registration position 16. Slide guides 17A and 17B maintain side alignment of document 12' as it is transported to registration position 16.

Document registration apparatus 10 is suitable for use in a queuing station, for example after a sheet feeder or an enclosure feeder, or in an inserting station of an inserting machine wherein documents 12 must be stopped and aligned before further processing. Apparatus 10 is suitably mounted to the frame (not shown) of the inserting machine. For example, apparatus 10 can be pivotally mounted at the upstream end to provide easy access for document jams. A more detailed description of such an arrangement is provided in U.S. application Ser. No. 808,863, noted previously herein.

Figure 3:
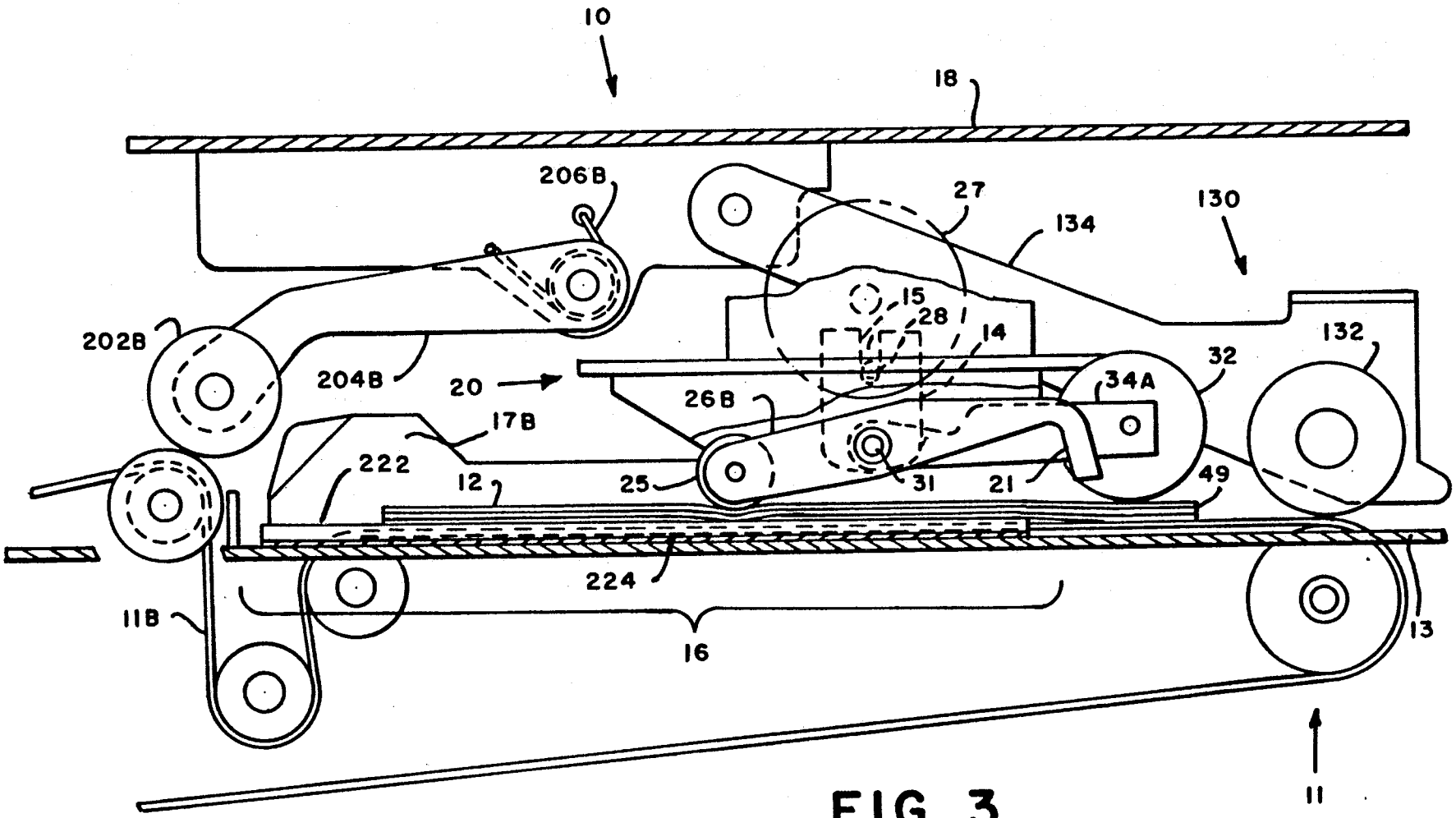
FIG. 3 is a side elevational view of the document registration apparatus of FIG. 1, with stops raised to remove the documents.
Figure 5:
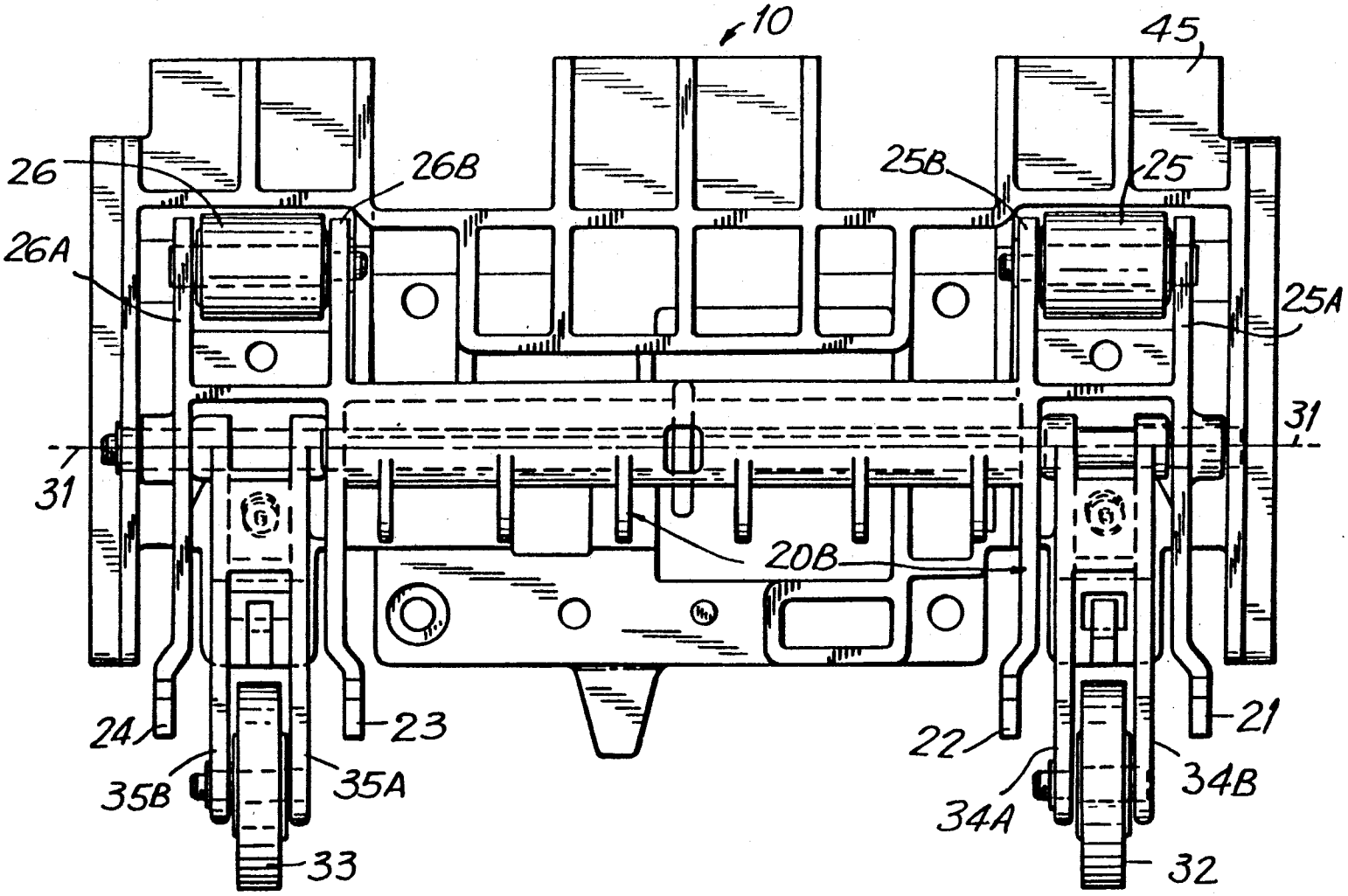
FIG. 5 is a bottom view of a registration unit of the document registration apparatus of FIG. 1.

Apparatus 10 comprises a document registration unit 20 pivotally mounted to top plate 18. As shown in FIGS. 1, 3 and 5, document registration unit 20 is preferably formed from a one piece document registration unit holder 45, to which a one piece frame member 20B is attached. Frame member 20B includes four registration stops 21, 22, 23 and 24 on the downstream end thereof and two pinch rollers 25 and 26 on pinch roller arms 25A-B and 26A-B, respectively, on the upstream end of unit 20. Urge rollers 25 and 26 are spaced at lateral positions between the lateral positions of registration stops 21 and 22 on the one hand, and the lateral positions of registration stops 23 and 24 on the other hand, respectively. Frame member 20B pivots vertically around pivot axis 31. A rotary solenoid 27 is linked to a pivoting arm 14 by a pin 28 which rides in a slot 15 of pivoting arm 14. Pin 28 moves along a circular path on each actuation of solenoid 27 and reciprocates in slot 15, thereby rocking pivot arm 14. As pivot arm 14 rocks, frame member 20B of document registration unit 20 pivots vertically around pivot axis 31.

The combination of registration stops 21-24 and pinch rollers 25 and 26 are used to stop and align documents 12 at document registration position 16, and then to release them for further processing. Documents 12 are aligned at this position so that they can subsequently be processed with minimal skew relative to path 13. For example, if documents 12 are collected to form a stack of documents which will subsequently be folded, then registration stops 21-24 ensure that the documents are aligned so that the folder can make a square fold of the documents.

Figure 2:
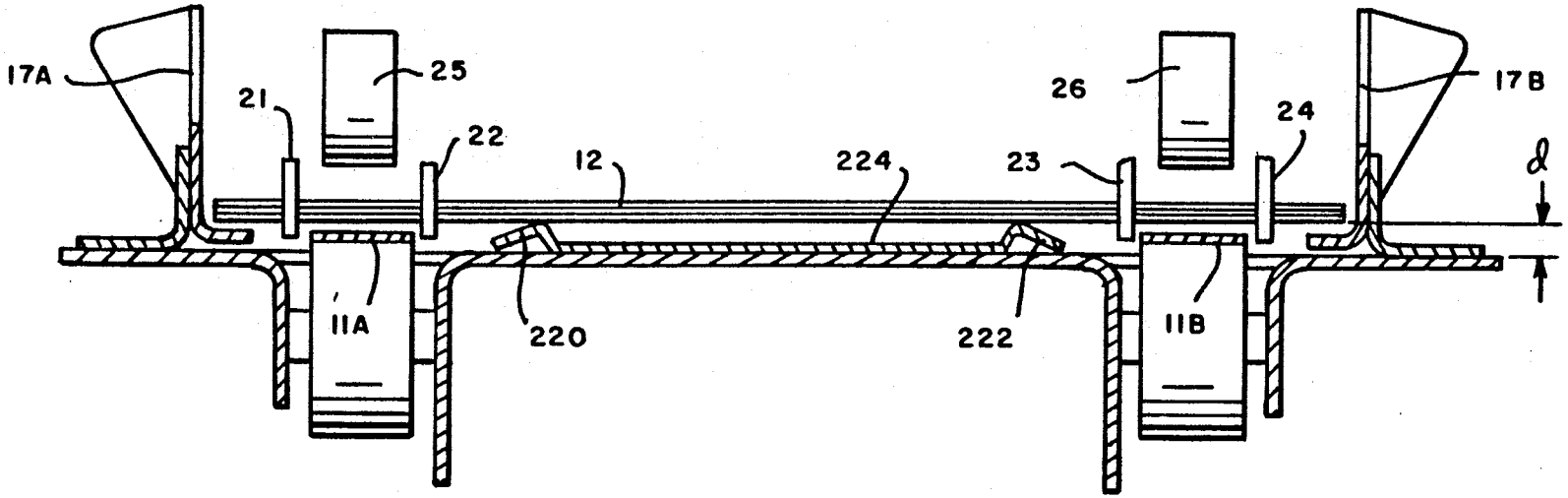
FIG. 2 is a partial front view of the document registration apparatus as shown in FIG. 1.

In order to stop documents 12 at document registration position 16, registration stops 21-24 are urged clockwise to a registration position, shown in FIGS. 1 and 2, by actuating solenoid 27. In this position, registration stops 21-24 extend into document path 13 so as to block documents 12 from being transported further downstream. Preferably, transport belts 11A and 11B are each approximately 0.5 inch wide. Laterally spaced on each side of each transport belt 11A and 11B are registration stops 21, 22 and 23, 24, respectively. Registration stops 21-24 are laterally-spaced along document registration unit 20 so that when documents 12 are stopped at document registration position 16, the downstream edges 49 of documents 12 are aligned with respect to document path 13.

Heretofore, as disclosed in U.S. patent applications Ser. Nos. 808,863, 906,200 and 906,170, the documents 12 were accumulated on a transport deck at registration position 16 and belts 11A and 11B were flush with the transport deck. Since the bottom document of the documents 12 accumulated at registration position 16 was in contact with the continuously moving transport belts 11A and 11B, belts 11A and 11B were continuously urging documents 12 against stops 21-24. Stops 21-24 were projected below the plane of transport belts 11A and 11B to assure that documents 12 could not slip through. Thus, when in the lowered or registration position registration stops 21-24 prevented the advancement or shingling of documents 12. However, when registration stops 21-24 were raised to release documents 12 a certain amount of shingling of documents 12 was caused by continuous moving belts 11A and 11B until pinch rollers 25 and 26 provided adequate force against documents 12 so that belts 11A and 11B could transport documents 12 as a stack.

Figure 4:
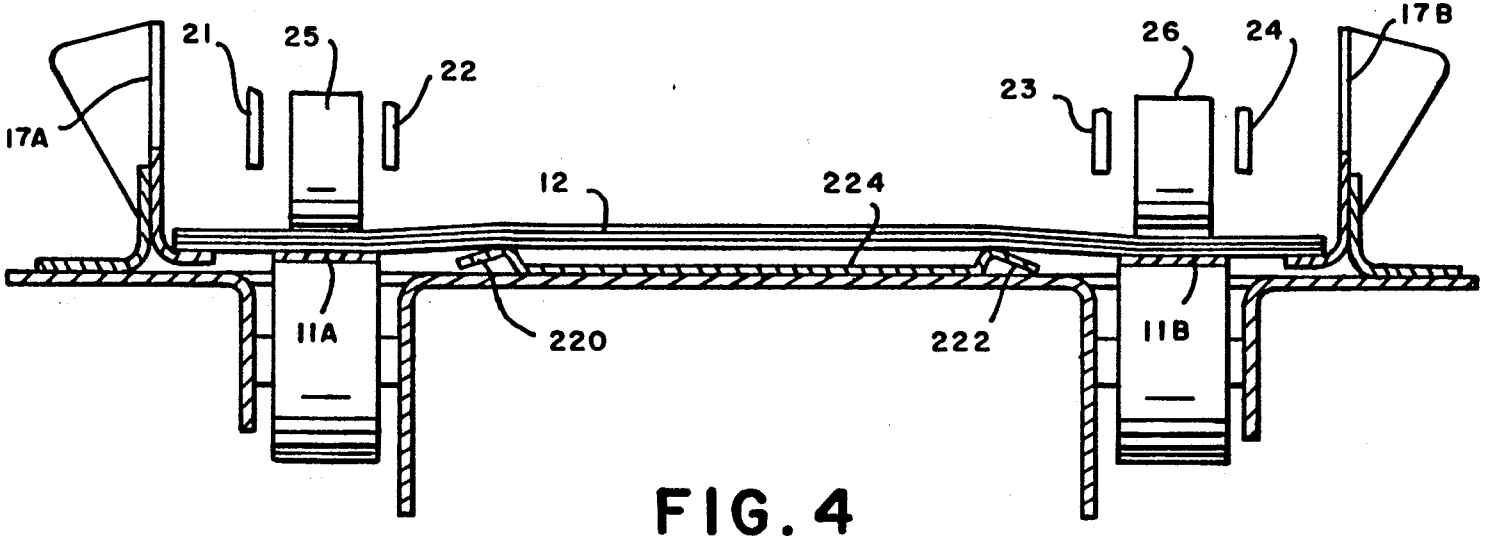
FIG. 4 is a partial front view of the document registration apparatus as shown in FIG. 3.

In accordance with the present invention, documents 12 are accumulated on a deck plane that is above belts 11A and 11B. As shown in FIGS. 1–4, a pair of rails 220 and 222 are part of a deck plate 224 located at registration position 16 between belts 11A and 11B. Rails 220 and 222 have a height "d" above belts 11A and 11B and are spaced laterally such that documents 12 remain above and do not touch belts 11A and 11B while being accumulated. In this manner, the continued travel of transport belts 11A and 11B do not affect documents 12 at registration position 16 until pinch rollers 25 and 26 urge documents 12 against belts 11A and 11B. When it is time to release documents 12, solenoid 27 is actuated to pivot registration stops 21–24 to a raised position and pinch rollers 25 and 26 are lowered, as shown in FIGS. 3 and 4. Pinch rollers 25 and 26 urge documents 12 against transport belts 11A and 11B, thus providing frictional force between documents 12 and transport belts 11A and 11B. The frictional force moves documents 12 downstream for further processing.

In the preferred embodiment of the present invention, rails 220 and 222 have a height of 0.020 inches above belts 11A and 11B. The length of rails 220 and 222 will be approximately the length of the longest document that will be fed into registration apparatus 10. Rails 220 and 222 are tapered toward belts 11A and 11B respectively to facilitate pinch rollers 25 and 26 urging documents 12 against the respective belts.

It will be appreciated by those skilled in the art that other means can be used to prevent contact between belts 11A and 11B and documents 12 until documents 12 are to be removed from registration position 16. For example, a raised surface of a different shape or configuration could be used, such as a solid, flat, raised deck surface with tapered sides. Alternately, belts 11A and 11B could be recessed below the deck on which documents 12 are accumulated. However, this is not an viable alternative if belts 11A and 11B are use to transport a previously accumulated stack of documents from an upstream station to registration position 16 so that document 12' can be added to the stack for further processing.

As documents 12 move in the downstream direction, they encounter exit pinch rollers 32 and 33 which are mounted on independent sets of support arms 34A, 34B and 35A, 35B, corresponding to exit pinch rollers 32 and 33, respectively, and which also pivot about pivoting axis 31. Arms 34A, 34B and 35A, 35B and thus rollers 32 and 33, are respectively spring biased by separate torsion springs (not shown) to pinch rollers 32 and 33 against transport belts 11A and 11B. Rollers 32 and 33 move away from belts 11A and 11B when documents 12 are released, but move back into engagement With transport belts 11A and 11B as soon as documents 12 are conveyed beyond rollers 32 and 33. The released stack of documents 12 is thus urged against transport belts 11A and 11B and transported for further processing. The mounting of pinch rollers 32 and 33 on separate support arms 34A, 34B and 35A, 35B prevents any shingling of documents 12 when they exit registration position 16. This is because rollers 32 and 33 and sets of arms 34A, 34B and 35A, 35B can move away from transport belts 11A and B as required by the thickness of the stack of documents 12 to allow the stack to pass, without lifting the remainder of unit 20.

Downstream from rollers 32 and 33 is a pinch roller assembly 130 which comprises a pair of pinch rollers 132 (only one is shown in FIGS. 1 and 3) which are rotatably mounted to support arm 134. Pinch roller assembly provides the last normal force that is applied by document registration apparatus 10 to documents 12 as they are conveyed away from its control.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. In a document registration apparatus for use with conveying means for transporting documents along a document path from an upstream direction to a downstream direction through a document registration position, said document registration apparatus including a plurality of laterally-spaced registration stops at a downstream end positioned substantially perpendicular to the document path for both stopping the documents at the document registration position and for aligning the documents relative to the document path when said stops are adjacent to the document path, and pinch roller means at an upstream end for urging the stopped documents against the conveying means, an improvement comprising:

means for supporting the documents above the conveying means when the documents are against the registration stops, said supporting means being laterally positioned adjacent the conveying means, wherein the conveying means includes a pair of transport belts situated in a fixed plane and said supporting means comprises at least one deck rail laterally positioned between said transport belts.

2. The improvement of claim 1 wherein the pinch roller means includes a pair of pinch rollers that pivot towards said transport belts to urge the document against said transport belts when the registration stops move away from said document path.

3. The improvement of claim 2 further comprising a plurality of deck rails positioned between said transport belts wherein any outer edge of said deck rails adjacent one of said transport belts is tapered towards belts.

4. The improvement of claim 2 wherein said at least one deck rail has a height of at least 0.020 inches above the plane of said transport belts.

5. In a document registration apparatus, for use with conveying means for transporting a document along a document path from an upstream direction to a downstream direction through a document registration position, comprising a document registration unit positioned above the document path adjacent to the document registration position, having an upstream end, a downstream end and a horizontal axis positioned in between the upstream end and the downstream end, a plurality of laterally-spaced registration stops at the downstream end of the unit positioned substantially perpendicular to the document path for both stopping a document at the document registration position and for aligning the document relative to the document path when said stops are pivoted adjacent to the document path, at least one pinch roller at the upstream end of the unit for urging a stopped document against the conveying means when said stops are pivoted away from the document path to move the document from the document registration position in the downstream direction, and pivoting means for pivoting said registration stops about a horizontal axis in said registration unit for selectively lowering said stops whereby said conveying document path and raising said stops whereby said conveying means transports said document from said registration position, an improvement comprising:

means for supporting the documents above the conveying means when the documents are against the registration stops, said supporting means being laterally positioned adjacent the converging means, wherein the conveying means includes a pair of transport belts and said supporting means includes at least one stationary deck rail laterally positioned between said transport belts.

6. The improvement of claim 5 wherein a pair of pinch rollers are provided said pinch rollers pivot towards said transport belts to urge the document against said transport belts when the registration stops move away from said document path.

7. The improvement of claim 2, wherein said deck rails have on outer edge that is tapered towards a respectively adjacent one of said transport belts.

8. The improvement of claim 7 wherein said deck rails have a height of at least 0.020 inches above the plane of said transport belts.

* * * * *